US006196318B1

(12) United States Patent
Gong et al.

(10) Patent No.: US 6,196,318 B1
(45) Date of Patent: Mar. 6, 2001

(54) METHOD FOR OPTIMIZING ACID INJECTION RATE IN CARBONATE ACIDIZING PROCESS

(75) Inventors: Ming Gong, Carrollton; Wadood El-Rabaa, Plano, both of TX (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/326,984

(22) Filed: Jun. 7, 1999

(51) Int. Cl.[7] ..... E21B 43/26

(52) U.S. Cl. ..... 166/308

(58) Field of Search ..... 166/305.1, 307, 166/308

(56) References Cited

U.S. PATENT DOCUMENTS

| | | | |
|---|---|---|---|
| 3,934,651 | 1/1976 | Nierode et al. | 166/282 |
| 4,487,265 | 12/1984 | Watanabe | 166/307 |
| 5,207,778 | 5/1993 | Jennings, Jr. | 166/281 |
| 5,297,628 | 3/1994 | Jennings | 166/281 |
| 5,441,929 | 8/1995 | Walker | 507/260 |
| 5,507,342 | 4/1996 | Copeland et al. | 166/279 |
| 5,520,251 | 5/1996 | Surles et al. | 166/307 |
| 5,881,813 | 3/1999 | Brannon et al. | 166/304 |

OTHER PUBLICATIONS

SPE 26578; The Optimum Injection Rate for Matrix Acidizing of Carbonate Formations; *Y. Wang, et al*; Oct. 3–6 1993; (pp. 675–687).

SPE 28547; *Optimum Injection Rate From Radial Acidizing Experiments*; B. Mostofizadeh, et al; Sep. 25–28 1994; (pp. 327–333).

SPE 37312; *Reaction Rate and Fluid Loss; The Keys to Wormhole Initiation and Propagation in Carbonate Acidizing*; T. Huang, et al; Feb. 18–21 1997; (pp. 1–10).

SPE 37283; *Mechanisms of Wormholing in Carbonate Acidizing*; M. Buijse; Feb. 18–21 1997; (pp. 683–686).

SPE 52165; *Quantitative Model of Wormholing Process in Carbonate Acidizing*; M. Gong; Mar. 28–31 1999; (pp. 1–11).

Chemical Engineering Science, vol. 48. No. 1 (pp. 169–178) 1993; *Chemical Dissolution of a Porous Medium by a Reactive Fluid–I. Model for the "Wo,mholing" Phenomenon*; G. Daccord, et al.

Chemical Engineering Science, vol. 48. No. 1. (pp. 179–186) 1993; *Chemical Dissolution of a Porous Medium by a Reactive Fluid–II. Convection VS Reaction, Behavior Diagram*; G. Daccord, et al.

AIChE Journal; vol. 34, No. 1, Jan. 1988; *Pore Evolution and Channel formation During Flow and Reaction in Porous Media*; M. Hoefner, H. Fogler; (pp. 45–54).

Society of Petroleum Engineers; 1993; *Advances in matrix Stimulation Technology*; G. Paccaioni, M. Tambini; (pp. 256–263).

(List continued on next page.)

*Primary Examiner*—David Bagnell
*Assistant Examiner*—Jennifer M Hawkins

(57) ABSTRACT

A method for optimizing the rate at which a given acid should be injected into a carbonate-containing rock formation during an acid injection process. The first step of the method calculates the Damkohler numbers for regimes in which kinematic force, diffusion rate and reaction rate control. The Damkohler numbers are then used to calculate the rate of growth of wormholes as a function of flux, taking into account compact dissolution, wormholing, and uniform dissolution. The calculated function is used to calculate an optimum flux for the formation. The optimum flux is then used to calculate an optimum injection rate at a given point in the acid injection process.

15 Claims, 1 Drawing Sheet

OTHER PUBLICATIONS

Journal of Petroleum technology, Feb. 1987; *Role of Acid Diffusion in Matrix Acidizing of Carbonates*; M. Hoefner, et al; (pp. 203–208).

*Oil Well Stimulation*; R. Schehter; Prentice–Hall, Inc. 1992; (pp. 6).

*Best Practices—Carbonate matrix Acidizing Treatments*; Halliburton Energy Services, Inc. Bibliography No. H01276;; Oct. 1998; (pp. 1–18.

Society of Petroleum Engineers; 1989; *Carbonate Acidizing: Toward A Quantitative Model of the Wormholing Phenomenon*; G. Daccord, et al; (pp. 63–68).

METHOD FOR OPTIMIZING ACID INJECTION RATE IN CARBONATE ACIDIZING PROCESS

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

This invention relates to acidizing of subterranean formations surrounding oil wells, gas wells and similar boreholes to increase the permeability of the formations or to remedy formation damage caused by drill-in and/or well completion fluids. More particularly, the invention relates to a method for optimizing acidization that is especially suitable for treating a hydrocarbon-producing formation comprising carbonates. Still more particularly, it relates to a method for calculating an optimal acid injection rate based on quantifiable parameters.

BACKGROUND OF INVENTION

Enhancing Well Productivity

It is often desired to increase the permeability of a subterranean reservoir that is penetrated by a well, so as to enable fluids to flow more easily into or out of the reservoir via the well. Fluids flowing into the well can be various fluids that are injected into the well for the purpose of enhancing the recovery and/or flowability of the desired hydrocarbons. Fluids flowing out of the well typically include the desired production fluids. Many rock formations that contain hydrocarbon reservoirs may originally have a low permeability due to the nature and configuration of the reservoir rock. Other reservoirs may become plugged or partially plugged with various deposits due to the flow of fluids through them, particularly drill-in fluids and/or completion fluids.

Matrix acidizing is a widely practiced process for increasing or restoring the permeability of subterranean reservoirs. It is used to facilitate the flow of formation fluids, including oil, gas or a geothermal fluid, from the formation into the wellbore; or the flow of injected fluids, including enhanced recovery drive fluids, from the wellbore out into the formation. Matrix acidizing involves injecting into the reservoir various acids, such as hydrochloric acid and other organic acids, in order to dissolve portions of the reservoir rock or deposits so as to increase fluid flow through the formation. The acid opens and enlarges pore throats and other flow channels in the rock, resulting in an increase in the effective porosity or permeability of the reservoir. In this sense, matrix acidizing refers to the treatment of homogeneous rock that is insufficiently porous.

Wormnholing

Wornholing is the preferred dissolution process for matrix-acidizing carbonate formations because it forms highly conductive channels efficiently. Hence, optimization of the formation of wormholes is the key to success of such treatments.

The ability to achieve increases in the near-wellbore permeability of formation and, therefore, the productivity of well by matrix acidizing in carbonate formations is related to fact that stimulation occurs radially outward from the wellbore. Because acid penetration (and the subsequent enhanced flow of oil or water) occurs through dominant wormholes that are etched in the rock by flowing acid, stimulation efficiency is controlled by the extent to which channels propagate radially away from the wellbore and into the formation. Under certain acidizing conditions, these channels may not propagate to a significant distance or they may not form at all.

Characterization of Wormholing Process

Numerous studies of the wormholing process in carbonate acidizing have shown that the dissolution pattern created by the flowing acid can be characterized as one of three types (1) compact dissolution, in which most of the acid is spent near the rock face; (2) wormholing, in which the dissolution advances more rapidly at the tips of a small number of highly conductive micro-channels, i.e. wormholes, than at the surrounding walls; and (3) uniform dissolution, in which many pores are enlarged, as typically occurs in sandstone acidizing. Compact dissolution occurs when acid spends on the face of the formation. In this case, the live acid penetration is limited to within centimeters of the wellbore. Uniform dissolution occurs when the acid reacts under the laws of fluid flow through porous media. In this case, the live acid penetration will be, at most, equal to the volumetric penetration of the injected acid. The objectives of the acidizing process are met most efficiently when near wellbore permeability is enhanced to the greatest depth with the smallest volume of acid. This occurs in regime (2) above, when a wormholing pattern develops.

The dissolution pattern that is created depends on the acid flux. Acid flux is the volume of acid that flows through a given area in a given amount of time, and is therefore given in units of velocity. (Units of $l^3/l^2 \cdot t = l/t$). Compact dissolution patterns are created at relatively low acid flux, wormhole patterns are created at intermediate flux, and uniform dissolution patterns at high flux. There is not an abrupt transition from one regime to another. As the acid flux is increased, the compact pattern will change to one in which large diameter wormholes are created. Further increases in flux yield narrower wormholes, which propagate farther for a given volume of acid injection. Finally, as acid flux continues to be increased, more and more branched wormholes appear, leading to a fluid-loss limiting mode and less efficient use of the acid. This phenomenon has a detrimental effect on matrix stimulation efficiency, especially at the rate where branches develop secondary branches. Ultimately then a uniform pattern is observed. The most efficient process is thus one that will create wormholes with a minimum of branching and is characterized by the use of the smallest volume of acid to propagate wormholes a given distance.

Experimental research has shown that the process of wormholing depends mainly on three parameters: (1) surface reaction rate, (2) acid diffusion rate, and (3) acid flux. The surface reaction rate determines how fast acid reacts with carbonates at the rock surface. This rate is a function of the rock properties, such as composition and crystallinity, and of acid properties, such as concentration. The acid diffusion rate indicates how fast an acid molecule is transported from the bulk of the fluid to the rock surface. The diffusion rate is a function of the acid system. Both of these parameters are also a function of temperature. Depending on the reactivity of formation rock, either the surface rate or the diffusion rate may control the overall acid spending rate, though both are always in balance with each other. Wormholes form when the overall acid spending rate is balanced by acid transportation, i.e. the acid convection rate, or flux. Therefore, a wormhole is the result of dynamic process of acid reaction, diffusion and transportation.

Existence of Critical or Optimum Flux

The efficiency of the carbonate matrix-acidizing requires the maximum radial penetration at the lowest acid volume. The optimum flux is the one corresponding to this lowest volume. Extensive experimental investigation have shown the existence of an optimum acid flux that corresponds to the smallest amount of acid required to create wormholes of a certain length. Whenever the flux exceeds the optimum, a reduction in the flux will improve performance. Similarly, increasing fluxes that are less than optimum will improve performance. Injecting acid close to or above the optimum flux is very crucial to assure a successful carbonate acid treatment because of the risk of compact dissolution that may resulted from a slower acid injection. In other words, injecting acid at a high rate will ensure a success in matrix acid treatment, and injecting acid at the optimum flux rate will ensure the most efficient and successful matrix acid treatment. However, the optimum is a complex function of the formation properties, acid properties, and acidizing conditions so that there can be no simple rules as to whether slow or fast rates are best. The complexity stems directly from the range of dissolution patterns created by acid reaction with carbonates.

A few models have been developed to quantify wormhole growth in carbonate acidizing. However, these models were unable to either predict wormhole growth accurately or estimate the critical flux practically because they focused on only some of the acidizing mechanisms. Hence, there remains a need for a technique that will allow calculation of an optimum acid flux, and from that an optimum acid injection rate. The desired technique should be accurate and should rely on quantifiable parameters.

SUMMARY OF INVENTION

The present invention provides a practical tool for field people to calculate optimum an flux for a given formation, accurately predict wormhole length and thus estimate the optimum acid injection rate based the predicted wormhole length. The invention includes a quantitative wormhole model that describes the wormholing process in carbonate acidizing. The model characterizes the wormholing process by introducing various acidizing dynamics, including acid reaction, diffusion and convection. Both the Damköhler number and the Peclet number are included in the model. The model allows accurate prediction of an optimum acid flux for a given carbonate formation.

Using multiple physical parameters, the model predicts the wormhole length as a function of acid flux when certain properties of the rock and acid are known. When compared with extensive experimental data on linear core flood in both limestone and dolomite, the model accurately predicts the wormhole breakthrough time. The critical flux (or optimum flux) is obtained using this model by differentiating and setting to zero the equation with respect to the flux.

The ability to estimate the critical flux enables field carbonate acid treatments to be more efficient. For practical applications, the model is properly extended to 2D and 3D radial flow geometry by introducing fractal dimensions. Specifically, the active wormholing area can be calculated or estimated by any of a number of preferred techniques. By combining the calculated optimum flux (units of l/t) with the preferred geometric estimation of active wormhole area (units of $l^2$), it is possible to generate an optimum volumetric acid injection rate ($l^2 \cdot l/t = l^3/t$) for a given formation at a given point in the wormholing process.

The model is both accurate and practical in prediction of the optimum flux. The parameters in model are all generally available or experimentally determinable. The accuracy and practicality of the model stem from the fact that it combines features of the convection-limited and surface reaction-limited regimes to express the overall process of wormholing in carbonate acidization.

BRIEF DESCRIPTION OF THE FIGURES

For an introduction to the detailed description of the preferred embodiments of the invention, reference will now be made to the accompanying drawings, wherein.

DETAILED DESCRIPTION OF THE INVENTION

Figure 1:
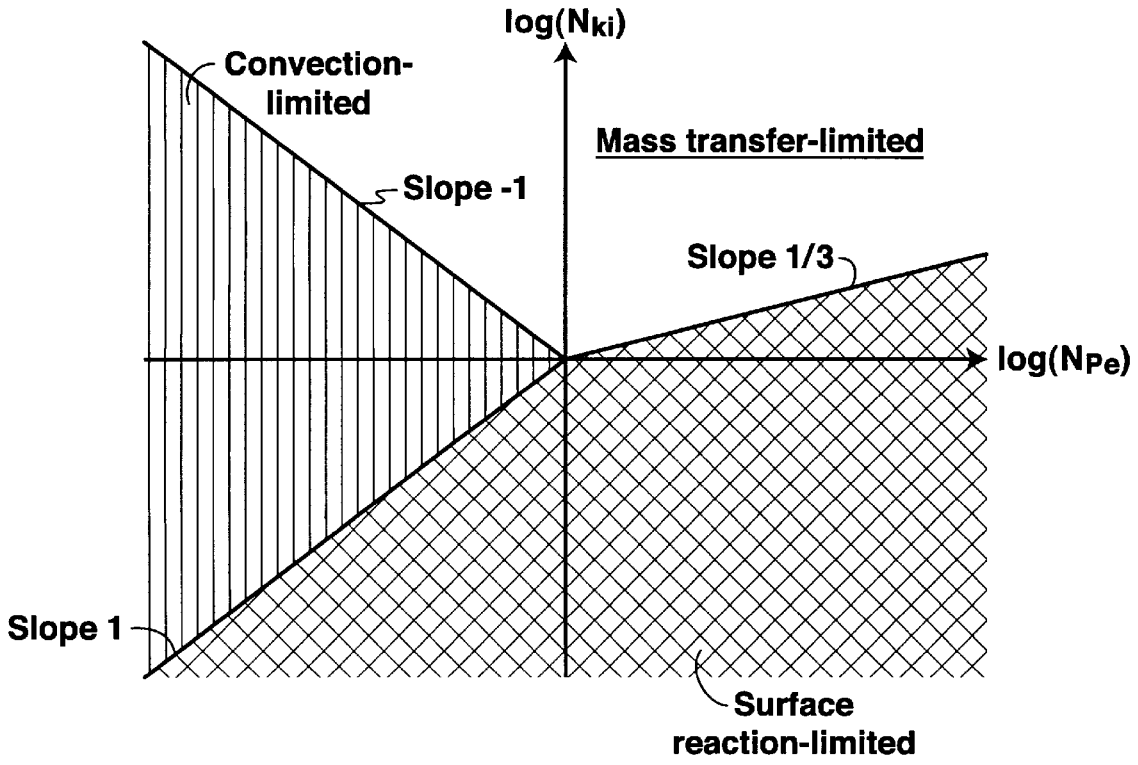
FIG. 1 is a schematic behavior diagram for a acidization in single capillary tube.

The starting point for the present model is the recognition that the optimum flux lies at the transition point from the convection limited regime to the surface reaction-limited regime. As shown in FIG. 1, when the acid flux is low, wormhole propagation is hindered due to slow acid convection, and the wormhole propagation speed is governed by balancing the convection and molecular diffusion. When the acid flux is high enough, the wormhole propagation is limited mainly by the reaction rate and the wormhole growth is governed by balancing the surface reaction and molecular diffusion.

In the discussion that follows, variables represent the quantities assigned in the following Table of Variables.

Table of Variables

| | |
|---|---|
| A, B | coefficients |
| a | constant in c |
| b | exponential constant in Damköhler number |
| C | acid concentration in g mole/cm$^3$ |
| $C_{\%}$ | acid concentration in weight percentage |
| $c_1$, $c_2$, $d_1$, $d_2$ | model coefficients; constant for a given rock |
| D | diffusion coefficient |
| $f_1$, $f_2$ | model coefficients |
| $d_f$ | fractal dimension |
| $E_f$ | effective forward reaction rate |
| h | height of radial flow core sample or wellbore length |
| K | acid reaction rate |
| k | permeability |
| L | length of core sample |
| l | effective wormhole length |
| $N_{ac}$ | acid capacity number |
| $N_{Da}$ | Damköhler number |
| $N_{Pe}$ | Peclet number |
| q | flow rate |
| PV | pore volume of acid consumption at time of wormhole breakthrough |
| R | radius of linear flow core sample |
| t | Time |
| u | acid flux |
| V | Volume |
| $\alpha$ | surface area ratio |
| $\beta$ | acid dissolving power |
| $\phi$ | rock porosity |
| $\mu_0$ | specific viscosity ($=\mu/\mu_w$) |
| $\rho_{acid}$ | acid density |
| $\rho_{rock}$ | rock density |
| $\upsilon$ | kinetic viscosity ($=\mu/\rho$) |

Wormhole growth velocity depends on the combined effects of reaction and convection as well as molecular transportation. Hence the rate of growth of the wormholes can be given by the following equation $$\frac{f_1}{N_{Pe}} + f_2 N_{Pe}^{\frac{1}{3}} \tag{1}$$

Investigation of experimental data relating to linear acid core flood suggests that the relationship between the acid pumping rate and the breakthrough time can be represented as:

$$PV = \frac{A}{q^2} + Bq^{\frac{1}{3}} \tag{2}$$

As is known in the art, the Damköhler number for a given acidization is dimensionless and indexes the competition between reaction and convection. Three different characterizations of the Damköhler number have been given. These represent the regimes in which kinematic force, diffusion rate and reaction rate, respectively, control. These three characterizations are:

$$N_{Da} = \frac{aD^{\frac{2}{3}}\lambda_i}{q_i^{1-b}\xi_i^b v^{b-\frac{1}{3}}} \tag{3}$$

$$N_{Da} = \frac{aD\lambda_i}{q_i} \tag{4}$$

$$N_{Da} = \frac{aK\lambda_i\xi_i}{q_i} \tag{5}$$

Similarly, The Peclet number is defined as the ratio of convective to diffusive flux. For radial flows, the Peclet number can be calculated according to:

$$N_{Pe} = \frac{q\sqrt{k}}{2\pi rL\phi D}. \tag{6}$$

A third dimensionless value that is needed to carry out the optimization according to the present invention is the acid capacity number, which is given as:

$$N_{ac} = \frac{\phi\beta C_{\%}\rho_{acid}}{(1-\phi)\rho_{rock}} \tag{7}$$

According to one aspect of the present invention, the combination of Equations 1 and 2 with the foregoing analysis gives the following relationship between the wormhole breakthrough time and $N_{Da}$, $N_{Pe}$ and $N_{ac}$:

$$PV = f_1\frac{N_{Da}^{2*}}{N_{Pe}} + f_2\frac{N_{Pe}^{\frac{1}{3}}}{N_{ac}} \tag{8}$$

Further according to the present invention, more accurate definitions for the Damköhler numbers, which is defined as the ratio of the reaction rate to the convection rate, in dolomite and limestone are given by equations (9) and (10) respectively, considering different rate-limiting regimes:

$$N_{Da}^{2*} = \frac{D^{\frac{5}{3}}\sqrt{k}}{(\mu/\rho)^{\frac{2}{3}}q} \tag{9}$$

$$N_{Da}^{2*} = \frac{KD^{\frac{2}{3}}k}{(\mu/\rho)^{\frac{2}{3}}q} \tag{10}$$

These approximations take into account the fact that in dolomite, which has a low reaction rate, the reaction is diffusion rate dominated, while in limestone, which has a high reaction rate, surface reaction dominates the dissolution process.

Using each equation (9) and (10) in equation (8), along with certain preferred parameters and variables gives:

$$PV = c_1\frac{k^{\frac{1}{2}}D^{\frac{5}{3}}E_f C^{m-1}}{(\mu/\rho)^{\frac{2}{3}}q^2} + c_2\frac{(1-\phi)\rho_{rock}}{\mu_0^{\frac{1}{2}}\phi\beta C_{\%}\rho_{acid}}\left(\frac{q\sqrt{k}}{D}\right)^{\frac{1}{3}} \tag{11}$$

$$PV = d_1\frac{(\rho/\mu)^{\frac{2}{3}}D^{\frac{8}{3}}}{\mu_0^4 q^2} + d_2\frac{\mu_0^2(1-\phi)\rho_{rock}}{\phi\beta C_{\%}\rho_{acid}}\left(\frac{q\sqrt{k}}{D}\right)^{\frac{1}{3}} \tag{12}$$

as the wormhole breakthrough times for dolomite and limestone, respectively.

In formations where, as is commonly the case, carbonate rocks comprise a mixture of dolomite and limestone, the behavior of the mixture can be estimated by combining the weighted contribution of each type of rock. Specifically, according to a preferred embodiment, the value for PV can be estimated as follows:

$$PV = ls\%PV_{ls} + dl\%PV_{dl}. \tag{13}$$

where ls% is the percent limestone present in the formation and dl% is the percent dolomite present in the formation.

By substituting equations (11) and (12) into equation (13), differentiating the resulting equation with respect to the acid flux, setting the resulting equation to zero and solving for u, it is possible to calculate a critical acid flux, $u_{crit}$, for one dimensional flow:

$$u_{crit} = \frac{2.155}{k^{\frac{1}{14}}(\mu/\rho)^{\frac{2}{7}}(\pi r^2\phi)^{\frac{5}{7}}}\cdot\left(\frac{ls\%\frac{c_1 k^{\frac{1}{2}}E_f D_{ls}^{\frac{8}{3}}}{C^{1-m}} + dl\%\frac{d_1 D_{dl}^{\frac{8}{3}}}{\mu_0^4}}{ls\%\frac{c_2}{\mu_0^{\frac{1}{2}}}\left(\frac{N_{ac}}{D^{\frac{1}{3}}}\right)_{ls} + dl\%\frac{d_2}{\mu_0^{-2}}\left(\frac{N_{ac}}{D^{\frac{1}{3}}}\right)_{dl}}\right)^{\frac{3}{7}} \tag{14}$$

In addition, the critical acid flux calculated in this manner, $u_{crit}$, can be multiplied by the nominal frontal area to give the critical acid injection rate $q_{crit}$. According to the present invention, in two dimensional radial flow (cylindrical flow) the nominal frontal area is defined in terms of the wormhole length, as follows:

$$A = 2\pi lh\phi \tag{15}$$

In Equation (15), h is the total height (or length along the borehole) of the acidization zone and is determined by either the strata, such as when a carbonate formation is sandwiched between two non-carbonate formations, or by equipment in the hole, such as casing.

The wormhole length needed in equation (15) can be calculated or estimated by any suitable method. According to one preferred method, wormhole length in two-dimensional radial flow is calculated according to the equation:

$$l = \left[\frac{q}{\pi\phi h}(ls\%PV_{ls} + dl\%PV_{dl})^{-1}t\right]^{\frac{1}{d_f}} \quad (16)$$

which is dependent on time and the values of PV for limestone and dolomite. It will be understood that the value of time (elapsed since the start of acidization) can be used as the basis for an estimation of nominal frontal area, in place of wormhole length, since one is proportional to the other. In general, the foregoing 2D calculations are preferred in most instances, as the overall acidization zone is substantially cylindrical. In cases where acid is injected into the formation through a perforated casing, the acidization zone at each perforation will initially follow a three-dimensional, spherical model, discussed below, but will ultimately approach a cylindrical model, as the wormhole length from each injection point (perforation) approaches one-half the distance between adjacent perforations and adjacent spherical acidization zones merge.

Wormhole length in three-dimensional radial flow (spherical flow) is calculated according to the equation:

$$l = \left[\frac{3q}{4\pi\phi}(ls\%PV_{ls} + dl\%PV_{dl})^{-1}t\right]^{\frac{1}{d_f}} \quad (17)$$

It will be noted that equations (16) and (17) include a fractal dimension, $d_f$. It is beyond the scope of the present disclosure to discuss the full derivation of $d_f$. Nevertheless, $d_f$ can be determined experimentally or by running computer simulations. Other parties attempting to find a suitable value for $d_f$ have placed it between about 1.6 and 1.7 for two-dimensional flow and between about 2.43 and 2.48 for three-dimensional flow. According to a preferred embodiment, $d_f$ is preferably selected within the appropriate one of these ranges.

Using the foregoing equations, an optimal acid flux can be calculated for any formation, and most particularly, for any limestone/dolomite formation. Similarly, the wormhole length at any time during the acid injection can be calculated, and the optimal acid injection rate, i.e. the injection rate needed to maintain the optimal flux at any given point in the injection can be calculated. Hence, the present invention provides a novel method for optimizing the acidizing process.

EXAMPLE

Edward limestone gas reservoir exists between 12,500 ft. to 13,500 ft. in the South Texas region around Halletsville. Matrix acid treatment in a vertical well named VS#2 was designed to cover 82 ft. of sweet spot of the pay between 13,560 ft. to 13,642 ft. Original design was to use 2⅜ inch tubing to convey the acid. A critical flux of 6.15 bbl/min was estimated using the present model. To accommodate such a rate, the tubing was redesigned to sit above 13,300 ft. of depth and rest was 5.5 inch casing. In addition, the volume of acid was determined so that a skin of negative two or better could be obtained. The model suggested a volume of >200 gal/ft of perforated pay.

| Treatment Parameters: | |
|---|---|
| Pumping rate | - 7 bbl/min |
| Pumped rate | - 520 bbls of 28% HCl |
| Treatment pressure | - 8000 ± 100 psi |
| Annulus pressure | - 5500 psi |
| DST result - skin | - (−4.4) |

Following treatment according the invention, VS#2 had a productivity index that was 2.5 times that of other wells in the same region. The productivity index (PI) is defined as production rate divided by the pressure difference, i.e.:

$$PI=q/(pe-pwf)$$

where pe is the pressure at the outer boundary of drainage area and pwf is the wellbore flow pressure.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

It will be understood that, while some of the claims may recite steps in a particular order, those claims are not intended to require that the steps be performed in that order, unless it is so stated.

What is claimed is:

1. A method for optimizing the rate at which a given acid should be injected into a into a carbonate-containing rock formation during an acid injection process, comprising the steps of:

(a) calculating the Damköhler numbers for regimes in which kinematic force, diffusion rate and reaction rate control;

(b) using the Damköhler numbers calculated in step (a) to calculate the rate of growth of the wormholes as function of flux, said function taking into account compact dissolution, wormholing, and uniform dissolution; and (c) using the function calculated in step (b) to calculate an optimum flux for the formation.

2. The method according to claim 1, further including the step of:

(d) using the optimum flux calculated in step (c) to calculate an optimum injection rate at a given point in the acid injection process.

3. The method according to claim 2, further including repeating steps (c) and (d) at intervals during the acid injection process.

4. The method according to claim 1, further including using the acid capacity number in step (b).

5. The method according to claim 1, further including using the Peclet number in step (b).

6. A method for calculating the rate of growth of wormholes as function of acid flux into a carbonate-containing formation, said function taking into account compact dissolution, wormholing, and uniform dissolution regimes, said method comprising:

(a) determining whether mass transfer, diffusion rate or reaction rate controls wormholing in at least one of the carbonates in the formation;

(b) calculating a Damköhler function for at least one type of carbonate in the formation, said Damköhler function reflecting the determination made in step (a);

(c) calculating a wormhole breakthrough time as a function of the Damköhler function calculated in step (b); and (d) calculating an optimal acid flux on the basis of the wormhole breakthrough time calculated in step (c).

7. The method according to claim 6, further including the steps of:

(e) calculating an estimated wormhole length for a given time in the acid injection process and (f) using the estimated wormhole length in conjunction with the optimal acid flux calculated in step (d) to calculate an optimal acid injection rate.

8. A method of calculating a wormhole breakthrough time for a given formation, comprising:

calculating the equation $$PV = f_1 \frac{N_{Da}^{2*}}{N_{Pe}} + f_2 \frac{N_{Pe}^{\frac{1}{3}}}{N_{ac}}$$

wherein $N_{Pe}$ is the Peclet number for the formation at a given acid flux, $N_{Da}{}^2$ is the Damköhler number for the formation at a given acid flow rate, and $N_{ac}$ is the acid capacity number.

9. The method according to claim 8 wherein the formation comprises dolomite and the Damköhler number is calculated according to $$N_{Da}^{2*} = \frac{D^{\frac{5}{3}}\sqrt{k}}{(\mu/\rho)^{\frac{2}{3}} q}$$

where D is a diffusion coefficient, k is permeability, $\mu$ is acid flux, ρ is acid density and q is acid flow rate.

10. The method according to claim 8 wherein the formation comprises limestone and the Damköhler number is calculated according to $$N_{Da}^{2*} = \frac{KD^{\frac{2}{3}}k}{(\mu/\rho)^{\frac{2}{3}} q}$$

where K is the acid reaction rate, D is a diffusion coefficient, k is permeability, $\mu$ is acid flux, ρ is acid density and q is acid flow rate.

11. The method according to claim 8 wherein the formation comprises a mixture of limestone and dolomite and the Damköhler number is calculated using a weighted combination of the Damköhler numbers for limestone and dolomite.

12. A method of calculating a wormhole breakthrough time for a given formation, and flow rate, comprising:

calculating the equation $$PV = c_1 \frac{k^{\frac{1}{2}} D^{\frac{5}{3}} E_f C^{m-1}}{(\mu/\rho)^{\frac{2}{3}} q^2} + c_2 \frac{(1-\phi)\rho_{rock}}{\mu_0^{\frac{1}{2}} \phi \beta C_{\%} \rho_{acid}} \left(\frac{q\sqrt{k}}{D}\right)^{\frac{1}{3}}$$

where K is the acid reaction rate, C is acid concentration in g mole/cm$^3$, D is a diffusion coefficient, E is the effective forward reaction rate, $\mu$ is acid flux, ρ is acid density, q is acid flow rate, ϕ is the rock porosity, $\mu_0$ is the specific viscosity ($=\mu/\mu_w$), $\rho_{acid}$ is the acid density and $\rho_{rock}$ is the rock density.

13. A method of calculating the optimum acid flux for a given formation, comprising:

calculating the equation $$u_{crit} = \frac{2.155}{k^{\frac{1}{14}} (\mu/\rho)^{\frac{2}{7}} (\pi r^2 \phi)^{\frac{5}{7}}} \cdot \left( \frac{ls\% \frac{c_1 k^{\frac{1}{2}} E_f D_{ls}^{\frac{8}{3}}}{C^{1-m}} + dl\% \frac{d_1 D_{dl}^{\frac{8}{3}}}{\mu_0^4}}{ls\% \frac{c_2}{\mu_0^{\frac{1}{2}}} \left(\frac{N_{ac}}{D^{\frac{1}{3}}}\right)_{ls} + dl\% \frac{d_2}{\mu_0^{-2}} \left(\frac{N_{ac}}{D^{\frac{1}{3}}}\right)_{dl}} \right)^{\frac{3}{7}}.$$

14. The method according to claim 13, further including the step of calculating the nominal frontal area A and multiplying it by the optimum acid flux to obtain an optimum acid injection rate.

15. The method according to claim 14 wherein the nominal frontal area is calculated according to the equation $$A = 2\pi l h \phi.$$

* * * * *